United States Patent [19]

Heinzle

[11] 4,271,770

[45] Jun. 9, 1981

[54] PUNCHED CARD CONTROL SYSTEM FOR EMBROIDERY MACHINE

[76] Inventor: August Heinzle, Altweg 9, A-6844 Altach, Austria

[21] Appl. No.: 122,846

[22] Filed: Feb. 20, 1980

[30] Foreign Application Priority Data

Feb. 20, 1979 [AT] Austria ..... 1305/79

[51] Int. Cl.[3] ..... D05C 5/04

[52] U.S. Cl. ..... 112/84

[58] Field of Search ..... 112/84, 85, 86, 121.11, 112/121.12

[56] References Cited

U.S. PATENT DOCUMENTS

| | | | |
|---|---|---|---|
| 435,875 | 9/1890 | Wilcox et al. | 112/84 |
| 911,234 | 2/1909 | Groebli | 112/84 |
| 2,649,065 | 8/1953 | Casper | 112/84 |
| 3,172,598 | 3/1965 | Carson et al. | 112/84 X |
| 3,459,144 | 8/1969 | Ramsey et al. | 112/121.11 |
| 3,459,145 | 8/1969 | Ramsey et al. | 112/121.11 |
| 3,863,310 | 2/1975 | Ochsner | 112/84 X |
| 4,052,945 | 10/1977 | Teetz | 112/86 |

*Primary Examiner*—H. Hampton Hunter

*Attorney, Agent, or Firm*—Toren, McGeady and Stanger

[57] ABSTRACT

A punched card control system for an embroidery machine which has an embroidery creel and a drive mechanism for driving the creel includes a number of lifter rods each arranged to sense a corresponding hole in successive groups of holes punched in a card or tape, each group of holes representing an operating instruction for the embroidery machine. A feed mechanism advances the card past the lifter rods while each rod is in a rest position relative to the feed mechanism, so that the holes of each group are confronted by corresponding ends of the lifter rods. The feed mechanism then displaces the card a certain distance toward the rods so that those rods whose ends confront holes in the card remain stationary, while the remaining rods are contacted at their ends by the card which then moves these rods from their rest positions. A reading device including electrical switching elements responds to the position of each lifter rod and provides corresponding output signals over a number of line channels. A control device is coupled between the channels of the reading device and the embroidery creel drive mechanism, and activates the drive mechanism so that the embroidery creel is adjusted in accordance with the output signals from the reading device.

5 Claims, 2 Drawing Figures

PUNCHED CARD CONTROL SYSTEM FOR EMBROIDERY MACHINE

BACKGROUND OF THE INVENTION

The present invention relates to a punched card control system for an embroidery machine, the system operating to control a drive mechanism in the machine which controls the movement of an embroidery creel.

A device for stitching, quilting or embroidering lengths of cloth or the like is known in which a conventional embroidery creel includes two carriages. The carriages are movable in mutually perpendicular directions so that the embroidery operation can be carried out by the machine in which the device is used. Control of the carriage movements is effected by way of a computer in which instructions are provided on a jacquard tape or card. The jacquard tape is punched in several rows according to a specific code which corresponds to the desired thread pattern. As the tape is being read, it moves directly against a number of pins each of which triggers a pulse when it senses a hole in the tape. However, when the tape is read in this manner, considerable interference due to, e.g., physical damage or taped over holes, may occur due to false actuations by the pins.

In addition, a drive arrangement for adjustment of embroidery frames in embroidery machines is known in which adjusting movement of the embroidery frames is provided in mutually perpendicular directions by means of conventional hydraulic adjustment drive mechanisms. These hydraulic drive mechanisms are connected with actual value transducers, and are controlled with electro-hydraulic control valves by a desired value transducer which is controlled by punched cards. Thus, a control device is provided which represents a considerable reduction in size of the known automatic mechanical control for embroidery machines, wherein movements representing a direction of rotation and rotational speeds in either direction are generated in the usual manner in a mechanism which is considerably reduced in size, and these movements are transferred to the desired value electrical transducer. Of course, such an arrangement can only be applied in new embroidery machines, since most all parts in existing automatic control mechanisms in embroidery machines would not be required. This arrangement is also very expensive, since it must effect an adjustment of the desired value transducer by mechanical means.

In the known arrangement discussed above, it is also suggested that the electrical contacts be controlled directly by a punched card which, for example, could be implemented by means of light sensitive electrical sensors. It is also known to transfer a punched card directly through a electrical or electronic reader wherein appropriate pulses are then triggered. These punched card arrangements have a proven disadvantage, however, in that the punched cards which are used must be new, i.e., they must not be physically damaged, nor may they have oil spots or the like such as might tend to make the cards translucent and falsely trigger the sensors in the reader.

Changes in the hole patterns in punched cards used in the embroidery industry occur quite often, and such changes are usually manually effected by a foreman with the aid of punch pliers. During the correction of a punched card, some of the existing holes may be taped over with clear or translucent adhesive tape strips. Also, it has become known that if there are, for example, oil spots on the punched card, which occurs quite often in the embroidery industry, the punched card becomes translucent. Because of the taped over areas, oil spots and the like which provide translucent regions on the cards, the card reader sensors are actuated even though no holes are actually present at such regions.

An object of the present invention is to overcome the above disadvantages and to provide a punched card control system for an embroidery machine which is simple to assemble and, nevertheless, efficient in its operation.

In accordance with the present invention, a punched card control system for an embroidery machine which has an embroidery creel and a first drive mechanism for driving the embroidery creel, includes a number of lifter rods each arranged to sense a corresponding hole in successive groups of holes arranged in a card, each group of holes representing an operating instruction for the embroidery machine. A feed mechanism advances the card past the lifter rods while each rod is in a rest position relative to the feed mechanism, so that the holes of each group are successively confronted by corresponding ends of the lifter rods. The feed mechanism then displaces the card a certain distance toward the rods so that those rods whose ends confront holes in the card remain stationary, while the remaining rods are contacted at their ends by the card which then moves these rods from their rest positions. A reading device including electrical switching elements responds to the condition of each lifter rod and provides corresponding output signals over a number of line channels. A control device coupled between the reading device channels and the first drive mechanism controls the first drive mechanism to adjust the movement of the embroidery creel in accordance with the output signals provided over the channels.

With the punched card control system of the present invention, each punched card is read mechanically with the result that minor damage such as oil spots on the card does not result in a false reading but, while electrical or electronic control of the drive mechanisms in the embroidery machine can take place. Mechanical reading and electrical or electronic reading techniques are combined so as to provide a considerable reduction in the number of mechanical parts used as compared to conventional automatic control systems. Yet, the advantages attendant to mechanical reading of the punched cards are maintained. Since heavy mechanical parts are not attached to the lifter rods, these rods can be of a much lighter construction and the forces required of springs which return them to their rest positions can be made considerably smaller. This arrangement also greatly reduces the wear of the punched cards since the contact pressure exerted by the lifter rods against the cards when the rods are at their rest positions can be greatly reduced or eliminated.

Existing automatic embroidery machines can also be easily converted in accordance with the present invention, since only appropriate electrical or electronic switching elements need be provided for already existing lifter rods which read the punched cards. A drive mechanism for driving the creel must also be provided. It can be shown that a punched card control system according to the present invention allows a large number (about 350) of the mechanical parts usually required in an embroidery machine to be omitted, which represents about 50 to 60% of the total number of mechanical parts normally provided. Accordingly, higher operating speeds and correspondingly faster stitch sequences can be realized, and a significant noise reduction will result as well. This noise reduction can be realized not only in new embroidery machines constructed according to the present invention, but also in old embroidery machines which are modified in accordance with the invention. In addition, wear and tear, the need for repairs, and lubrication and maintenance costs are significantly reduced, while the durability of the machine is substantially increased.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
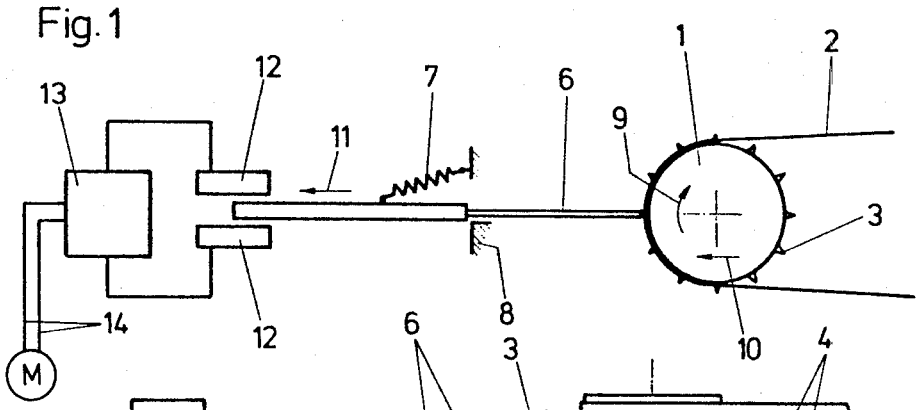
FIG. 1 is a schematic representation of a punched card control system according to the present invention.
Figure 2:
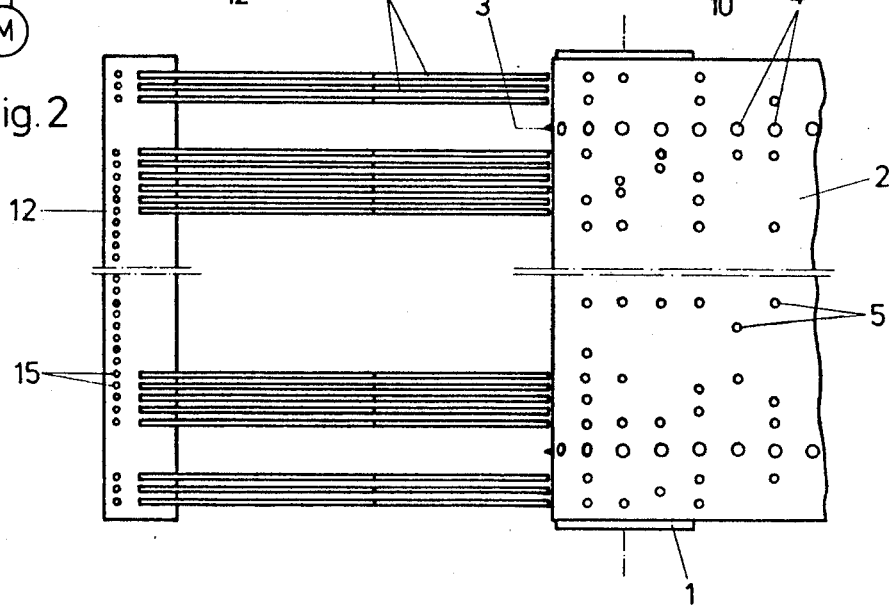
FIG. 2 is a plan view of a portion of the system of FIG. 1.

FIGS. 1 and 2 show a punched card control system in accordance with the present invention. One or more drive mechanisms for driving an embroidery creel or other parts of an embroidery machine are not shown individually in detail since each mechanism may be arranged according to one of a number of different conventional designs. For example, electrically or hydraulically operated drive mechanisms can be employed, these mechanisms being connected with the embroidery creel or other parts of the machine in any desired manner. Accordingly, in FIG. 1, M generally represents at least one such drive mechanism.

A punched card 2 consists of an endless tape which is guided for movement over the outer circumferential surface of a reading roller 1. The reading roller 1 is arranged to be rotated about its axis and to be movable in a direction perpendicular to its axis. Reading roller 1 is coupled to a suitable feed drive arrangement (not shown) which controls the movement of the roller, as described below. Spikes 3 project radially outwardly from the surface of the reading roller 1 to engage corresponding feed holes 4 provided in the punched card 2, thereby ensuring that the punched card is properly aligned relative to the reading roller 1. The punched card 2 has groups of holes 5 arranged in successive rows each of which extends perpendicularly to the path of movement of the punched card 2. The number of holes 5 and the positions of the holes in a given row represent a particular operation to be performed by the embroidery machine.

A number of elongated lifter rods 6 are provided for sensing the holes 5 in each hole group. The lifter rods 6 extend generally in a common plane and in parallel, spaced apart relationship, each rod 6 extending perpendicularly to the axis of the reading roller 1 so that one end thereof confronts the card 2 on the outer circumferential surface of the reading roller 1. The rods 6 are thus arranged so that their ends confront each group of holes in the punched card 2, successively, as the card is fed or advanced past the rods 6 by the reading roller 1 which is rotated in a stepwise manner by the feed drive arrangement. Each of the lifter rods 6 is also arranged to be movable in its long direction. A spring 7 biases each of the lifter rods 6 toward a rest position relative to the reading roller 1 whereat the ends of the rods are held a certain distance from the surface of the reading roller 1 by a stop 8.

During operation of the embroidery machine, the reading roller 1 is rotated in a stepwise manner by the feed drive arrangement in the direction of the arrow 9 to feed the punched card 2 past the ends of the rods 6, each of the rods 6 being in its rest position. After each stepwise movement, the reading roller 1 is displaced by the feed drive arrangement in the direction of arrow 10 toward the ends of the lifter rods 6. Upon each such displacement of the reading roller 1, those rods whose ends confront holes in the card remain stationary, while the remaining rods are contacted at their ends by the card 2 which then moves these rods in their long directions as shown by arrow 11 out of their rest positions. The biasing effect of the springs 7 ensures that those rods which confront holes in the card 2 remain in their rest positions. Next, the reading roller 1 is displaced by the feed drive arrangement in the direction opposite the arrow 10 to its feeding position, so that the lifter rods 6 which were moved in the direction of arrow 11 are returned to their rest positions by the action of the springs 7. The movements described above occur at successive intervals, in accordance with the feed advancement of the punched card 2.

From the sequence of the movements of the reading roller 1 and the lifter rods 6, it will be appreciated that electrical or electronic switching elements in, for example, an electrical or electronic reading device 12, can be arranged to detect the condition of each of the lifter rods 6. Depending on the particular construction of the reading device 12, it will respond either to those lifter rods which are moved, or to those rods which remain stationary, so that corresponding pulse signals can be transmitted to a control device 13. In the control device 13, for example, a desired value adjustment for the creel height and its lateral position are combined, wherein the pulse signals thus provided are transmitted to the drive mechanisms M by way of connecting lines 14. As shown in FIG. 2, line channels 15 are provided in the reading device 12, the number of the channels 15 corresponding to the number of lifter rods. By the use of the reading device 12, not only those instructions read from the punched card 2, but other special instructions can be provided by the reading device 12 as well. By use of the punched card control system of the present invention, it is possible to control not only the driving of the creel, but additional operations in an embroidery machine can be controlled as well. For example, a drive mechanism responsive to the punched card control system can be operatively connected to a yarn roller in the embroidery machine. Also, since the control device 13 provides pulse signals which control the degree of adjustment of the embroidery creel, the control device 13 may also operate to provide signals which result in an appropriate advancing feed of the yarn during movement of the embroidery creel, or immediately before movement of the embroidery creel, thereby resulting in a considerable reduction of yarn breakage. In addition to the control instructions originating from the punched card 2, pulse signals can be provided for causing forward or backward movement of the yarn roller. For example, in the formation of loops and stitches, an additional advance feed movement of the yarn roller is required and, after the loop or stitch is formed, the yarn is tightened by a backward movement of the yarn roller.

Existing embroidery machines of any construction can be redesigned or converted in accordance with the present invention, and 46 channel readers as well as 8 channel readers may be employed so that multiple-head embroidery machines can also be modified.

It should be noted that, in a fully electronic reader, old punched cards must always be replaced since oil spots, taped over areas or other like damage to the card will make it no longer possible to read correctly information from the card. With the mechanical-electrical reading arrangement of the present invention, old punched cards can be properly used without the need for their replacement. It should also be noted that punched card collections exist which carry instructions for patterns which were manufactured 50 years ago, or even earlier. Thus, with the punched card control system of the present invention, these punched card collections can still be used without any problem.

While specific embodiments of the invention have been shown and described in detail to illustrate the application of the inventive principles, it will be understood that the invention may be embodied otherwise without departing from such principles.

What is claimed is:

1. A punched card control system for an embroidery machine which includes an embroidery creel and a first drive mechanism for driving the embroidery creel, comprising a number of elongated movable lifter rods each arranged to sense a different hole in successive groups of holes punched in a card, each group of holes representing an operating instruction for the embroidery machine, said lifter rods being out of contact with the first drive mechanism, feed means for advancing the card past said lifter rods while each rod is in a rest position relative to said feed means so that each group of holes in the card successively confronts corresponding ends of said lifter rods in the rest position, means for applying a bias force to each of said lifter rods to urge said lifter rods toward the rest position, means for moving said feed means to displace the card a certain distance toward said lifter rods so that those lifter rods whose ends confront holes in the card remain in the rest position and the remaining lifter rods are contacted at their ends by the card wherein said remaining lifter rods are moved from the rest position, said feed means applying a displacement force to the card sufficient to overcome said bias force applied to said remaining lifter rods and to move said remaining lifter rods from the rest position, reading means including a number of electrical switching elements directly responsive to the position of each of said lifter rods for detecting the position of each of said lifter rods and providing corresponding electrical output signals over a number of line channels, and control means coupled between said channels of said reading means and the first drive mechanism for controlling the first drive mechanism to adjust the embroidery creel in accordance with the electrical output signals provided over said channels of said reading means.

2. A control system according to claim 1, wherein said feed means comprises a reading roller mounted for rotational movement about its axis and arranged to engage the card to be read on the outer circumferential surface of said reading roller, each of said lifter rods extending in its long direction perpendicularly to the axis of said reading roller.

3. A punched card control system according to claim 2, wherein said reading roller is arranged to be moved by said feed means in the long direction of each of said lifter rods to displace the card said certain distance toward said rods.

4. A punched card control system according to claim 1, wherein the number of said line channels provided in said reading means corresponds to the number of said lifting rods.

5. A punched card control system according to claim 1, wherein the embroidery machine has a yarn roller and a second drive mechanism for driving the yarn roller, and said reading means is arranged to provide output signals to said control means for controlling the second drive mechanism to obtain a desired movement of the yarn roller.

* * * * *